US005150011A

United States Patent [19]

Fujieda

[11] Patent Number: 5,150,011

[45] Date of Patent: Sep. 22, 1992

[54] GAS DISCHARGE DISPLAY DEVICE

[75] Inventor: Yoshihiro Fujieda, Osaka, Japan

[73] Assignee: Matsushita Electronics Corporation, Osaka, Japan

[21] Appl. No.: 664,199

[22] Filed: Mar. 4, 1991

[30] Foreign Application Priority Data

Mar. 30, 1990 [JP] Japan ..... 2-86570

[51] Int. Cl.[5] ..... G09G 3/10

[52] U.S. Cl. ..... 315/169.4; 315/169.2; 340/771; 340/775; 313/586; 313/584

[58] Field of Search ..... 315/169.2, 169.4, ; 313/584–586; 340/771, 775

[56] References Cited

U.S. PATENT DOCUMENTS

| | | | |
|---|---|---|---|
| 4,079,370 | 3/1978 | Mikoshiba et al. | 340/775 |
| 4,206,386 | 6/1980 | Akutsu et al. | 315/169.4 |
| 4,286,265 | 8/1981 | Kauffman et al. | 315/169.4 |
| 4,326,148 | 4/1982 | Okamoto et al. | 315/169.4 |
| 4,333,040 | 6/1982 | Okamoto et al. | 315/169.2 |
| 4,562,434 | 12/1985 | Amano | 340/771 |
| 4,566,006 | 1/1986 | Okamoto et al. | 315/169.4 |
| 4,692,666 | 9/1987 | Okamoto et al. | 315/169.4 |
| 4,799,058 | 1/1989 | Okamoto et al. | 315/169.4 |

FOREIGN PATENT DOCUMENTS

| | | |
|---|---|---|
| 61-30279 | 7/1986 | Japan . |
| 62-12623 | 3/1987 | Japan . |
| 63-312317 | 12/1988 | Japan . |
| 2-157793 | 6/1990 | Japan . |

*Primary Examiner*—Eugene R. LaRoche

*Assistant Examiner*—Michael B. Shingleton

*Attorney, Agent, or Firm*—Lowe, Price, LeBlanc & Becker

[57] ABSTRACT

A gas discharge display device including a display panel in which a discharging space between a transparent front plate and a rear plate is partitioned by a large number of long and thin dielectric partitions, and discharge cells are provided in solid crossing portions of stripe-shaped anodes each intervening between a pair of the dielectric partitions and stripe-shaped cathodes arranged in a direction intersecting the anodes, and a third electrode covered with a dielectric layer is provided at the rear side of the cathodes and further a reset electrode is provided in a region contiguous to the cathodes, wherein a voltage enough to cause a displaying discharge is applied to predetermined anodes to cause displaying discharges in a period when the cathodes are serially scanned, and further an electric potential of the third electrode is changed to make the dielectric layer store electric charge during a vertical blanking interval in which the cathodes are not scanned, and moreover scanning discharges are caused between the stored charges and the cathodes during the cathodes are serially scanned, and wherein an electric potential of the reset electrode is changed in a period from a moment, at which an electric potential of the third electrode is changed, to another moment, at which the serial scan of the second electrodes is commenced, so that a reset discharge is caused between the reset electrode and each of the anodes and thus an electric potential of the anodes is made to have a predetermined value.

9 Claims, 5 Drawing Sheets

GAS DISCHARGE DISPLAY DEVICE

BACKGROUND OF THE INVENTION

1. Field of the Invention

This invention relates to a gas discharge display device for driving a display panel of what is called a plasma display panel (PDP) type and displaying graphic characters and forms by lighting up individual points in gas with which a region between a front and rear panels thereof is filled.

2. Description of The Related Art

A typical conventional gas-discharge display device provided with a large number of cathodes which are serially discharged by performing a scanning discharge (an auxiliary discharge) is disclosed in Japanese Patent Application Publication No. 61-30279 Official Gazette. Further, another conventional gas-discharge display device is disclosed in Japanese Patent Application Publication No. 62-12623 Official Gazette. In this conventional gas-discharge display device, a group of first electrodes serving as anodes and a group of second electrodes acting as cathodes are provided. Further, a discharge cell is provided at each solid crossing portion of a first and second electrodes. Moreover, a discharging space is partitioned by long and thin dielectric barriers each intervening between neighboring first electrodes. Furthermore, third electrodes covered with a dielectric layer are provided with the side of the group of second electrodes. In case of this gas-discharge display device, an electric potential of a third electrode corresponding to a discharge cell to be discharged is maintained to be lower than an electric potential of the cathodes, while an electric potential of the remaining third electrodes is kept higher than the electric potential of the cathodes.

The above-mentioned conventional gas-discharge display device has an advantage in that the number of elements of a driving circuit for performing a scanning discharge (i.e., a priming discharge or an auxiliary discharge) can be reduced, but has a drawback in that sufficient reliability in regard to a scanning discharge function is not obtained.

Thus, in Japanese Patent Application No. 63-312317, the inventor of the present invention has proposed a gas-discharge display device wherein a negative pulse is applied to a third electrode in a vertical blanking interval in which a serial scanning of a group of second electrodes is not performed, so that an electric charge is stored in a dielectric layer and further a scanning discharge (i.e., a priming discharge or an auxiliary discharge) is caused between this electric charge and a second electrode. This gas-discharge display device can obtain high reliability with regard to a priming effect, as well as an image display with a high contrast. This gas-discharge display device, however, has encountered a problem that a false discharge is liable to occur in a discharge cell corresponding to an electrode which is first scanned after a vertical blanking interval.

SUMMARY OF THE INVENTION

To achieve the foregoing object and in accordance with the present invention, there is provided a gas discharge display device including a display panel in which a discharging space between a transparent front plate and a rear plate is partitioned by a large number of long and thin dielectric partitions arranged in a direction into a large number of discharge paths, and discharge cells are provided in solid crossing protions of strip-shaped first electrodes each intervening between a pair of the dielectric partitions and stripe-shaped second electrodes arranged in a direction intersecting the first electrodes, and a third electrode covered with a dielectric layer is provided at the rear side of the group of the second electrodes and further a reset electrode is provided in a region contiguous to the group of the second electrodes, wherein a voltage enough to cause a displaying discharge (hereunder referred to as a displaying discharge voltage) is applied to predetermined ones of the first electrodes to cause displaying discharges in a period when the group of the second electrodes are serially scanned, and further an electric potential of the third electrode is changed to make the dielectric layer store electric charge during a vertical blanking interval in which the group of the second electrodes are not scanned, and moreover scanning discharges are caused between the stored charges and the second electrodes during the group of the second electrodes are serially scanned, and wherein an electric potential of the reset electrode is changed in a period from a moment, at which an electric potential of the third electrode is changed, to another moment, at which the serial scan of the second electrodes is commenced, so that a reset discharge is caused between the reset electrode and each of the first electrodes and thus an electric potential of the first electrodes is made to have a predetermined value.

Thus, a negative pulse is applied to the third electrode in a vertical blanking interval in which the serial scan of the group of the second electrodes is not effected, so that electric charge is stored in the dielectric layer. That is, electric charge required for a priming discharge is generated on all of exposed surfaces of the dielectric layer included in a displaying region. However, what is called a prime is not transferred. Further, a priming discharge (i.e., an auxiliary discharge) is caused between the stored discharge and the second electrode. On the other hand, a discharge is caused between the first electrode and the reset electrode by changing the electric potential of the reset electrode. Consequently, by using a relatively simple driving circuit, the gas discharge display device of the present invention can cause a scanning discharge with a high priming effect and high reliability. Moreover, a voltage sufficient to make the second electrodes serially scanned cause a discharge is applied to the first electrodes in a period from a moment when the electric potential of the third electrode changes to another moment when the electric potential of the reset electrode varies. That is, a reset discharge corresponding to a false discharge occurred in the conventional device is forcibly caused on the reset electrode adjacent to the group of the second electrodes. Thus, an occurrence of an unexpected discharge in the displaying region is prevented. Consequently, the gas discharge display device of the present invention can prevent a false discharge as described above from occurring. Further, picture quality of a displayed picture can be improved.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which.

DETAILED DESCRIPTION OF THE PREFERRED EMBODIMENTS

Hereinafter, preferred embodiments of the present invention will be described in detail by referring to the accompanying drawings.

Figure 1:
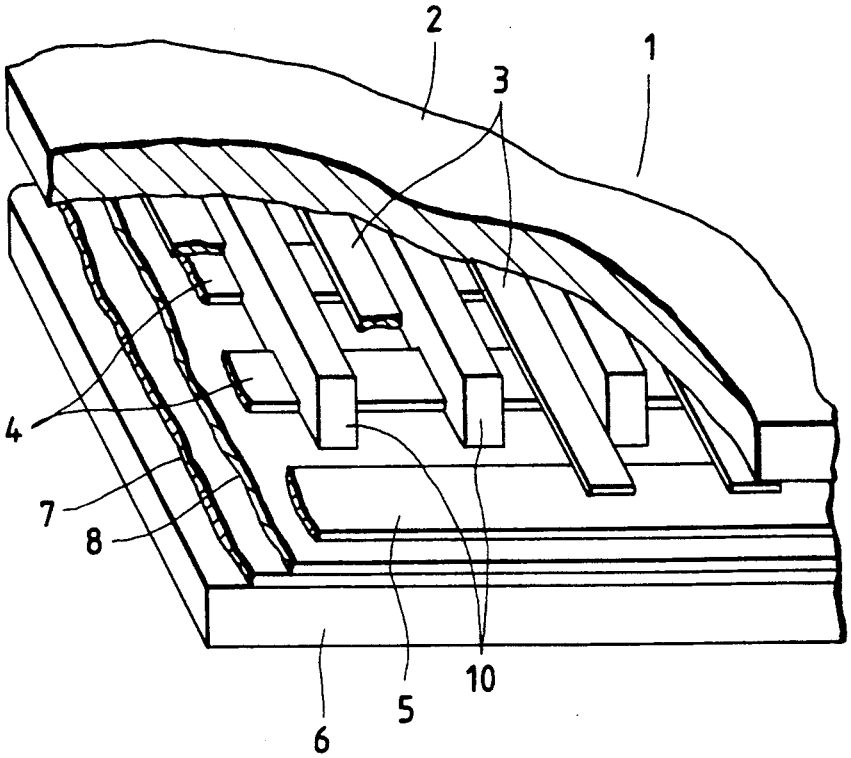
FIG. 1 is a partly fragmentary perspective view of a display panel of a gas-discharge display device embodying the present invention.
Figure 2:
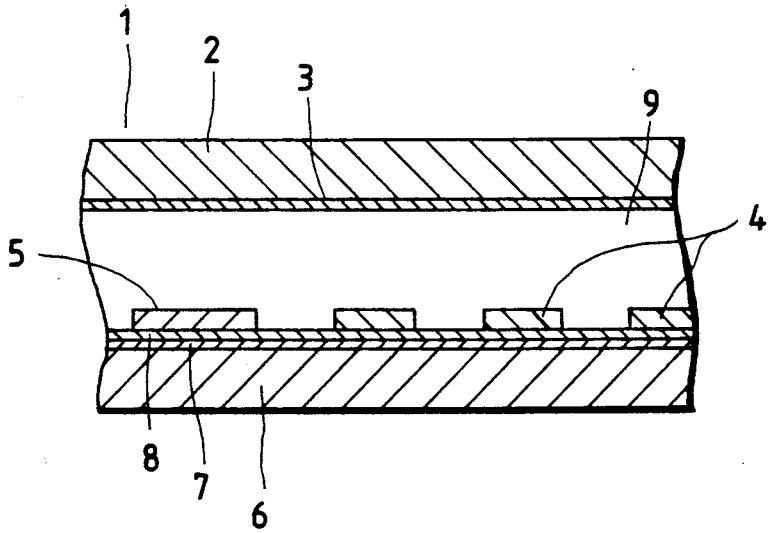
FIG. 2 is a sectional side elevation view of the display panel of FIG. 1.

Referring to FIGS. 1 and 2, there is shown a display panel (PDP) 1 of gas-discharge display device embodying the present invention. As illustrated in these figures, a group of first electrodes 3 which serve as anodes are provided on the inside surface of a front plate 2 made up of a transparent flat glass plate. Further, a group of second electrodes 4 which serve as cathodes and a reset electrode 5 are provided on the inside surface of a rear plate 6 made up of a flat glass plate by way of both of a layer of a third electrode 7 and a dielectric layer 8. Incidentally, the group of the first electrodes 3 are transparent conductive stripe shaped films arranged in a direction, and similarly the group of the second electrodes 4 are conductive stripe shaped films. Moreover, the group of the first electrodes 3 are formed by performing vaporization and selective etching in such a manner to overpass the group of the second electrodes 4 and the reset electrode 5, which are formed by effecting a thick-film printing, by way of a discharging space 9. Furthermore, long and thin partitions 10, each of which is provided between a pair of the stripe shaped films forming the group of the first electrodes 3, are dielectric layers for partitioning the discharging space 9 and are formed by repeatedly effecting a thick-film printing and a baking of them on each of the front and rear plates 2 and 6. The top surface of each partition is in contact with the dielectric layer 8 and the group of the second electrodes 4, and the bottom surface thereof touches the inside of the front surface 2.

Further, the front and rear plates 2 and 6 are hermetically sealed by frame shaped flint glass layers (not shown) provided in peripheries thereof in such a fashion to form a casing in which a mixture of rare gases for discharging (e.g., discharge gases of neon, argon and the like) is enclosed. Moreover, in this embodiment, the discharging space 9 above the reset electrode 5 is not partitioned by the dielectric partitions 10. This is because there is no necessity of forming a discharge cell on the reset electrode 5. In passing, so long as a discharge between the group of the the first electrodes and the reset electrode 5 is not prevented, dielectric partitions 10 may be provided on the reset electrode 5.

Figure 3:
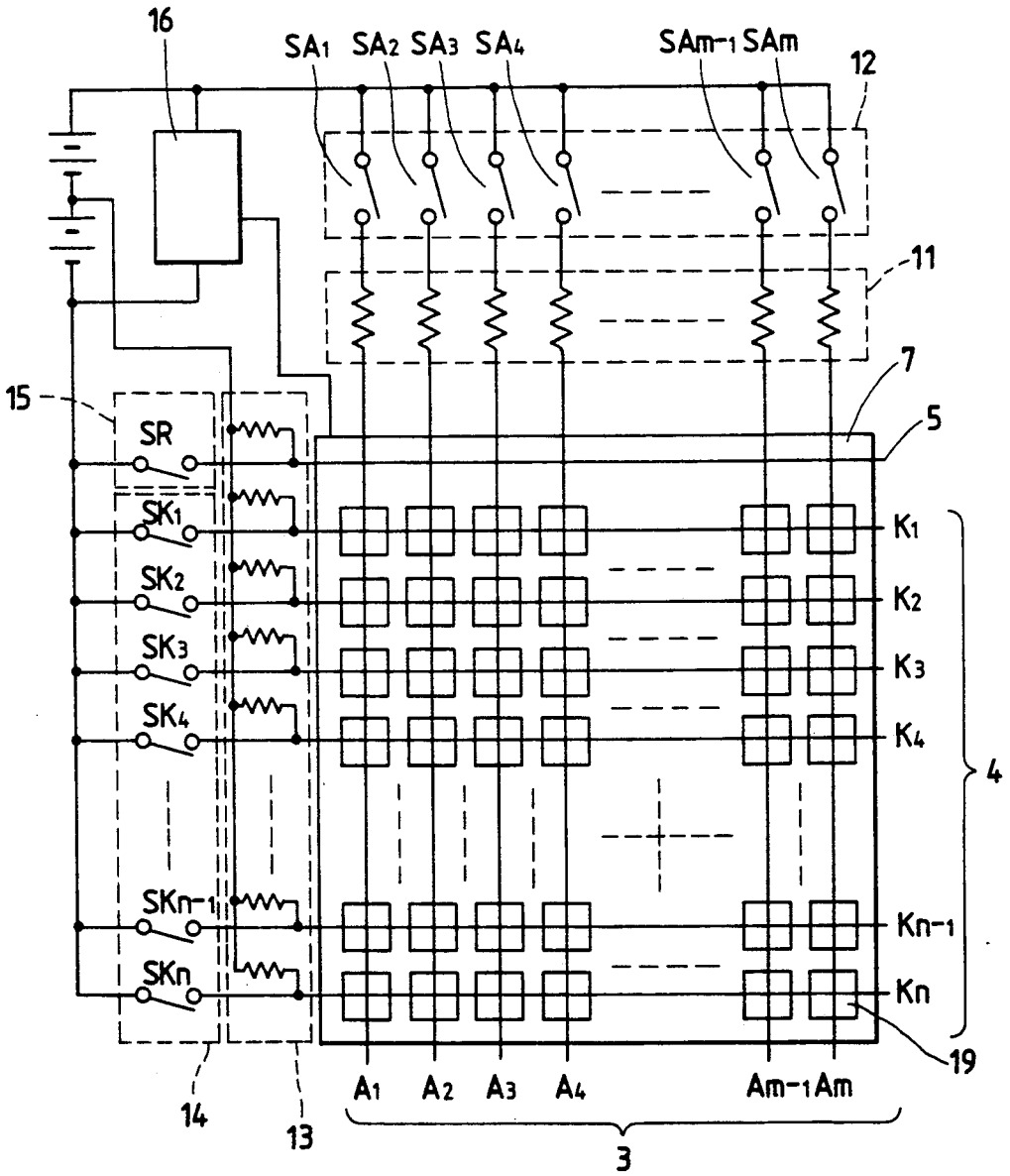
FIG. 3 is a circuit diagram of a driving circuit provided in a periphery of the display panel of the gas-discharge display device of FIG. 1.

The thus constructed PDP 1 performs a lighting and displaying operation according to an operating principle which will be described hereinbelow. Referring to FIG. 3, there are shown the driving circuits provided in peripheries of the PDP 1. In FIG. 3, reference characters $A_1$, $A_2$, . . . and $A_m$ denote the first electrodes 3, respectively; and $K_1$, $K_2$, . . . and $K_n$ the second electrodes 4. Further, in the following description, a solid crossing portion of a first and second electrodes will be referred to as a displaying cell or a discharging cell 19, and a region in which displaying cells are arranged in a matrix-like manner will be referred to simply as a displaying region. Moreover, the third electrode 7 is a single conductive film and has an area larger than an area of the displaying region.

Further, the group of the first electrodes 3 are connected to an anode driving circuit 12 through current-limiting resistances 11. On the other hand, the group of the second electrodes 4 are connected to a cathode driving circuit 14 through pre-bias resistances 13 which give an off-electric-potential thereto. Similarly, the reset electrode 5 is connected to a reset-electrode driving circuit 15 through a pre-bias resistance 13, though the reset electrode 5 is not employed to establish a discharge cell. Incidentally, in FIG. 3, switching circuit portions $SA_1$, $SA_2$, . . . and $SA_m$ of the anode driving circuit 12, switching circuit portions $SK_1$, $SK_2$, . . . and $SK_n$ of the cathode driving circuit 14 and a switching circuit portion SR of the reset-electrode driving circuit 15 are schematically illustrated for simplicity of drawing. In addition, as shown in FIG. 3, the third electrode 7 is connected to a third-electrode driving circuit 16.

When the switching circuit portions $SK_1$, $SK_2$, . . . and $SK_n$ of the cathode driving circuit 14 are serially turned on, corresponding cathodes $K_1$, $K_2$, . . . and $K_n$ are scanned in a horizontal direction, as viewed in FIG. 3. In contrast with this, switching circuit portions $SA_1$, $SA_2$, . . . and $SA_m$ of the anode driving circuit 12 are selectively turned on in accordance with display information. Further, a driving pulse synchronized with a vertical synchronization signal is applied to the third electrode in a vertical blanking interval. Moreover, the reset electrode 5 is driven by the switching circuit portion SR by the time when the cathodes $K_1$, $K_2$, . . . and $K_n$ are scanned after the pulse is applied to the third electrode 7.

Figure 4:
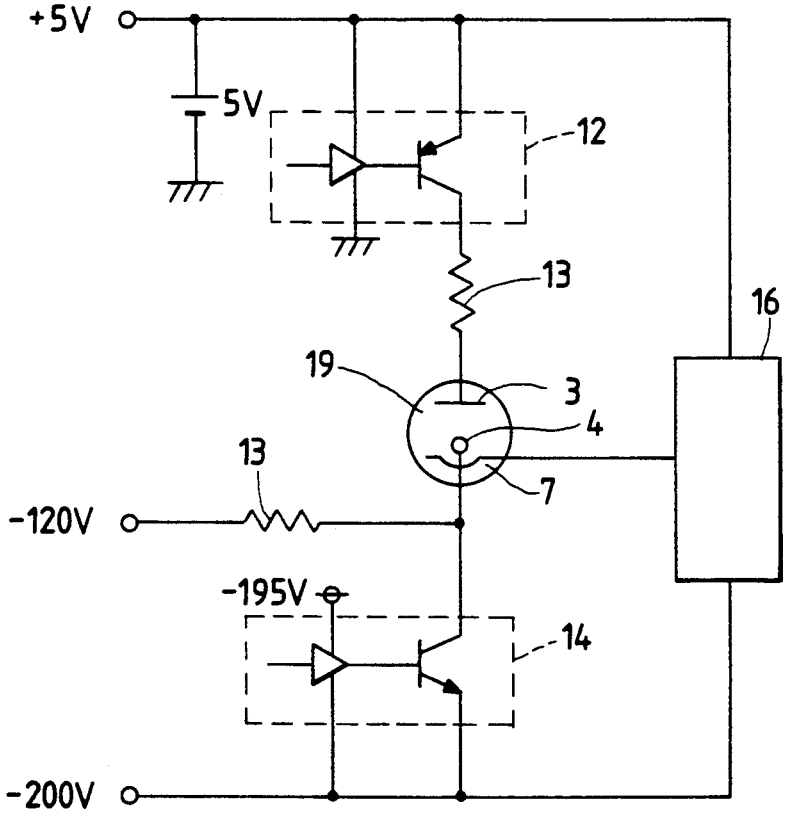
FIG. 4 is a circuit diagram of a fundamental driving circuit of a discharge cell of the gas-discharge display device of FIG. 1.

Referring next to FIG. 4, there are illustrated a discharging cell 19 and a fundamental driving circuit for driving the discharging cell. A transistor of the anode driving circuit 12 connected to a power source of 5 volts for supplying a signal is turned on or turned off in accordance with the display information. Further, a transistor of the cathode driving circuit 14 connected to a high-voltage power source of −200 volts supplies an electric potential of −200 volts to a cathode when the cathode is scanned, namely, turned on. Moreover, the transistor of the cathode driving circuit 14 supplies a pre-bias potential of −120 volts to a cathode when the cathode is turned off. The third-electrode driving circuit 16 produces a high voltage higher than the potential of the high-voltage power source and supplies a pulse voltage of −300 volts to the third electrode 7.

Figure 5:
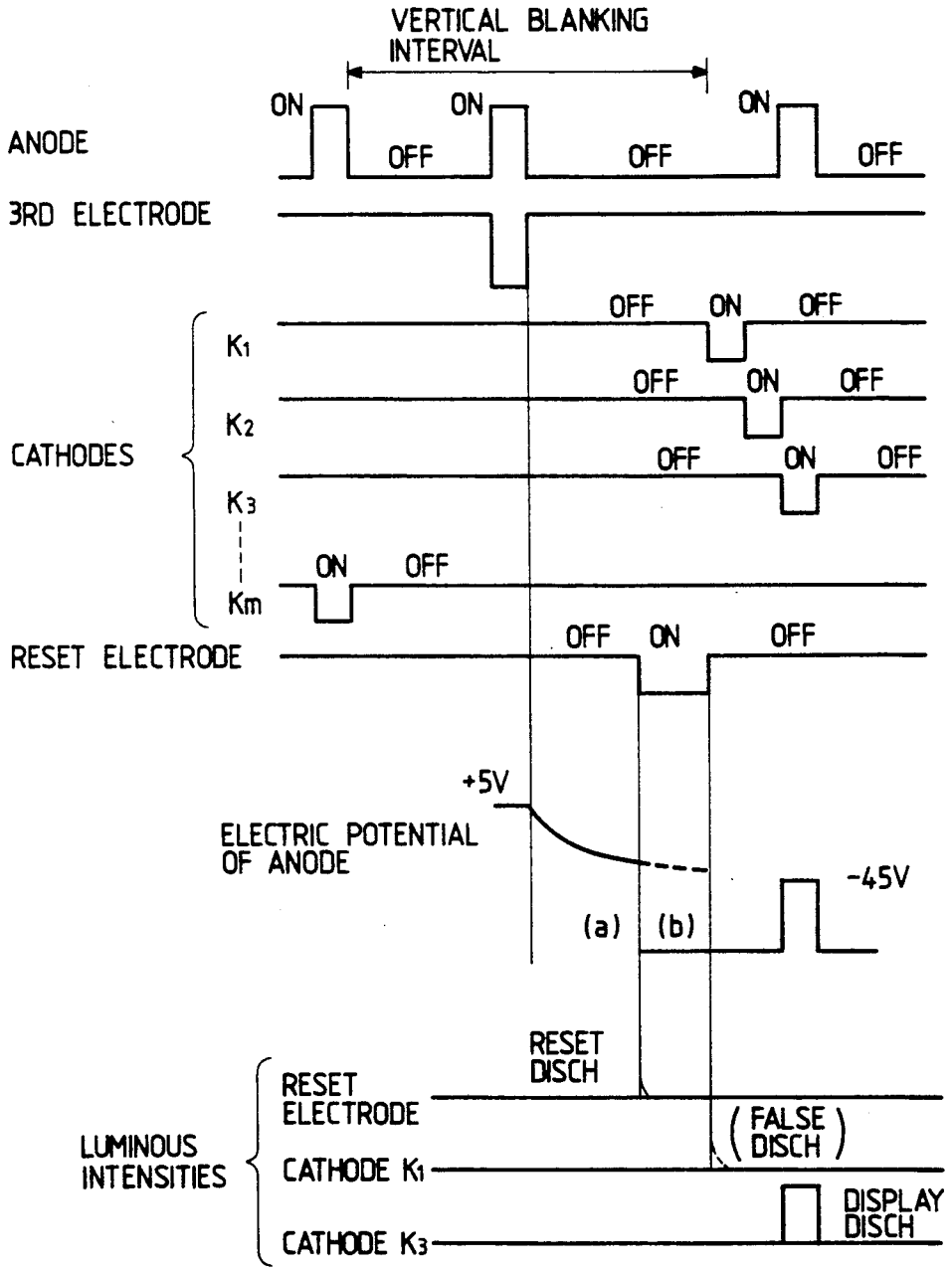
FIG. 5 is a diagram for showing waveforms and luminous intensities at various portions of the gas-discharge display device of FIG. 1.

Turning to FIG. 5, there is shown relation among the timing of the pulse voltage applied to the third electrode 7, variation in electric potential of an anode and luminous intensities at the reset electrode and the cathodes. The anode is in an on-state or an off-state in accordance with the display information during a displaying period, and has an on-potential (namely, is in an on-state) in synchronization with the third-electrode driving pulse during a vertical blanking interval. The cathodes $K_1$, $K_2$, . . . and $K_n$ are serially scanned, and the reset electrode receives a pulse voltage by the time when the cathode $K_1$ is scanned after the third-electrode driving pulse is applied to the third electrode.

The electric potential of the anode anode becomes 5 volts at the time of the application of the third-electrode driving pulse to the third electrode, and has a high level due to storage of electric charge by stray capacity by the time when the gas-discharge display device enters the displaying period. Further, when the reset electrode has an on-potential, a very small discharge (a reset discharge) occurs between the reset and the anode. Thus, a very small emission of light is cause on the reset electrode, and the electric potential of the anode falls as illustrated in FIG. 5(*a*). If the potential of the reset electrode does not vary as described above, a very small discharge corresponding to the reset discharge occurs as a false discharge in a discharge cell which corresponds to the cathode $K_1$ and does not perform a displaying discharge when the cathode $K_1$ is scanned.

Thus, in case of this embodiment, a reset discharge is forced to occur in a cell other than the discharge cell effecting a display discharge, and a drop in the electric potential of the anode is caused. As a result, possibility of an occurrence of a reset discharge in a displaying region as a false discharge is eliminated.

Incidentally, instead of applying a voltage to the reset electrode by using the stray capacity, a reset discharge may be forcibly caused by applying a displaying discharge voltage to the reset electrode.

Figure 6A:
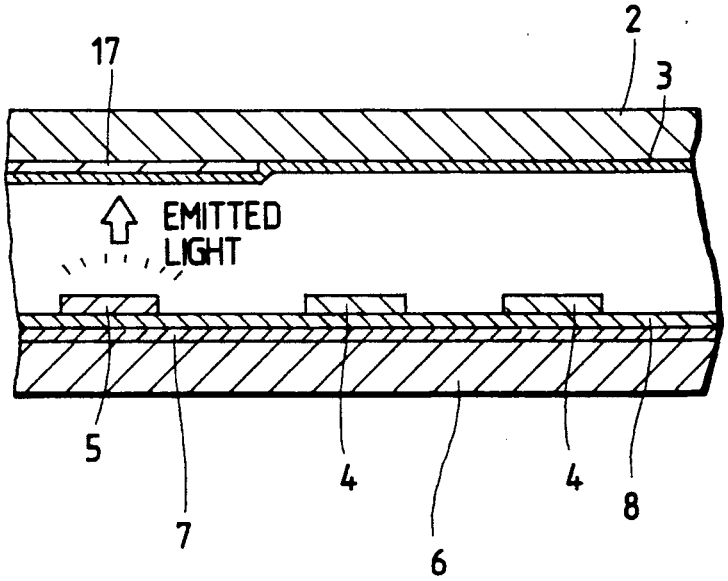
FIGS. 6(*a*) and 6(*b*) are sectional side elevation views of modifications of the display panel of the gas-discharge device shown in FIG. 1.
Figure 6B:
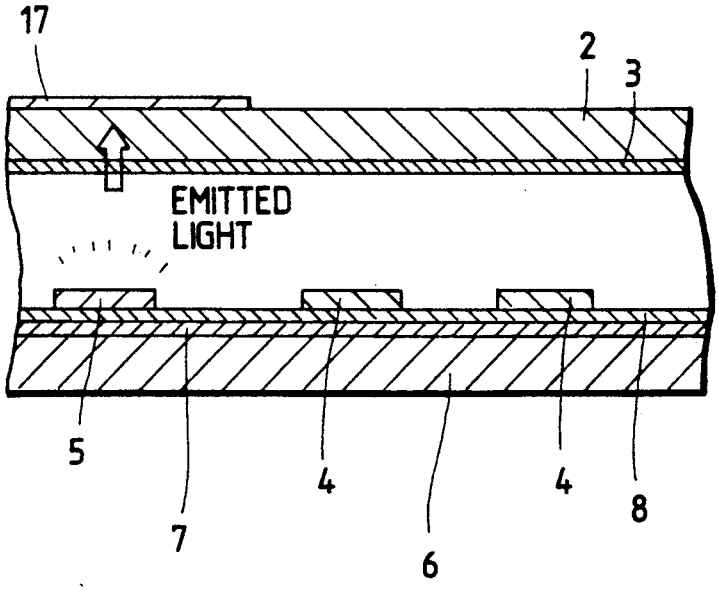

Additionally, in an embodiment of FIG. 6(*a*), a shading mask 17 is provided on the inside surface of the transparent front plate 2 in such a manner to prevent light emitted due to the reset discharge from filtering through the plate 2. Further, in another embodiment of FIG. 6(*b*), a tape-like shading mask 17 is provided on the outside surface of the transparent front plate 2.

While preferred embodiments of the present invention has been described above, it is to be understood that the present invention is not limited thereto and that other modifications will be apparent to those skilled in the art without departing from the spirit of the invention. The scope of the present invention, therefore, is to be determined solely by the appended claims.

What is claimed is:

1. A gas discharge display device having a plasma display panel provided with a transparent front plate, a rear plate facing said front plate, dielectric partitions arranged in a direction for partitioning a discharging space into discharge paths, a group of stripe-shaped first electrodes each positioned between a pair of said dielectric partitions and acting as an anode, a group of stripe-shaped second electrodes arranged in a direction intersecting another direction, along which each of said first electrodes extends, and acting as cathodes and a third electrode covered with a dielectric layer and provided at a rear side of said group of said second electrodes, a discharge cell being provided in crossing portions of said first and second electrodes, said gas discharge display device further comprising a reset electrode provided in a region contiguous to said group of said second electrodes and a driving circuit connected to said first, second, third and reset electrodes for applying a voltage to cause a displaying discharge to predetermined ones of said first electrodes to thereby cause displaying discharges in a period when said group of said second electrodes are serially scanned, for further applying a negative pulse to said third electrode and also for applying a positive pulse to said first electrode to make said dielectric layer store electric charge during a vertical blanking interval in which said group of said second electrodes are not scanned, and moreover cause scanning discharges between the stored charges and said second electrodes during said group of said second electrodes are serially scanned, and for changing an electric potential of said reset electrode in a period from a moment, at which an electric potential of said third electrode is changed, to another moment, at which the serial scan of said second electrodes is commenced, so that a reset discharge is caused between said reset electrode and each of said predetermined ones of said first electrodes and thus an electric potential of said predetermined ones of said first electrodes is made to have a predetermined value, wherein said third electrode is a single conductive film, and said third electrode and said dielectric layer are provided to an area corresponding to an entire area of a displaying region of said gas discharge display device.

2. A gas discharge display device as set forth in claim 1, wherein said predetermined first electrodes are maintained in a floating state when the electric potential of said reset electrode is changed, thereby causing a discharge due to stray capacity.

3. A gas discharge display device as set forth in claim 1, wherein the voltage used to cause a displaying discharge is applied across each of said predetermined first electrodes and said reset electrode when the electric potential of said reset electrode is changed.

4. A gas discharge display device as set forth in claim 1, wherein said driving circuit comprising:

an anode driving circuit connected to said group of said first electrodes through current-limiting resistances for driving said group of said first electrodes in accordance with display information;

an cathode driving circuit connected to said group of said second electrodes through pre-bias resistances for driving said group of said second electrodes;

a third-electrode driving circuit connected to said third electrode for driving said third electrode; and a reset-electrode driving circuit connected to said reset electrode through a pre-bias resistance for driving said reset electrode.

5. A gas discharge display device as set forth in claim 1, further comprising a shading means mounted on inside surface of said front plate for preventing light emitted due to the reset discharge from filtering through said front plate.

6. A gas discharge display device as set forth in claim 1, further comprising a shading means mounted on outside surface of said front plate for preventing light emitted due to the reset discharge from filtering through said front plate.

7. A gas discharge display device as set forth in claim 4, wherein said anode driving circuit includes a plurality of first solid state means each connected to a corresponding one of said first electrodes for turning on and off according to the display information.

8. A gas discharge display device as set forth in claim 4, wherein said cathode driving circuit includes a plurality of second solid state means each connected to a corresponding one of said second electrodes and to a high-voltage source for supplying a first electric potential to said first electrodes when said solid state means turns on and for supplying a second electric potential to said first electrodes through said pre-bias resistances when said solid state means turns off.

9. A gas discharge display device as set forth in claim 4, wherein said third-electrode driving circuit supplies a first voltage to said third electrode, said voltage being higher than a second voltage of a voltage source, to which said cathode driving circuit is connected.

* * * * *